United States Patent [19]

Marchak et al.

[11] 4,114,570

[45] Sep. 19, 1978

[54] START ENRICHMENT CIRCUIT FOR INTERNAL COMBUSTION ENGINE FUEL CONTROL SYSTEM

[75] Inventors: Roman O. Marchak, Northville; Glen J. Drellishak, Rochester, both of Mich.

[73] Assignee: The Bendix Corporation, Southfield, Mich.

[21] Appl. No.: 752,376

[22] Filed: Dec. 20, 1976

[51] Int. Cl.[2] ..... F02B 3/02; F02M 7/00

[52] U.S. Cl. ..... 123/32 EG; 123/32 EA; 123/179 L; 123/179 G; 123/119 A

[58] Field of Search ..... 123/32 EG, 32 EA, 179 L, 123/179 G, 119 A

[56] References Cited

U.S. PATENT DOCUMENTS

| | | | |
|---|---|---|---|
| 3,566,846 | 3/1971 | Glockler | 123/32 EA |
| 3,705,571 | 12/1972 | Horn et al. | 123/32 EA |
| 3,749,070 | 7/1973 | Oishi et al. | 123/32 EA |
| 3,923,031 | 12/1975 | Keranen | 123/32 EG |
| 3,971,354 | 7/1976 | Luchaco et al. | 123/32 EA |
| 4,027,641 | 6/1977 | Moder | 123/32 EA |

*Primary Examiner*—Charles J. Myhre
*Assistant Examiner*—P. S. Lall
*Attorney, Agent, or Firm*—James R. Ignatowski; Russel C. Wells

[57] ABSTRACT

Disclosed herein is a start enrichment circuit for an electronic fuel control system when the engine temperature is above or below its nominal operating temperature range. The circuit produces a start enrichment signal having an initial temperature dependent value while the starter is being energized which decay as a function of time after the engine starts. The preferred embodiment also provides a start enrichment signal within the nominal engine temperature range when the exhaut gas recirculation valve is in an activated state.

14 Claims, 10 Drawing Figures

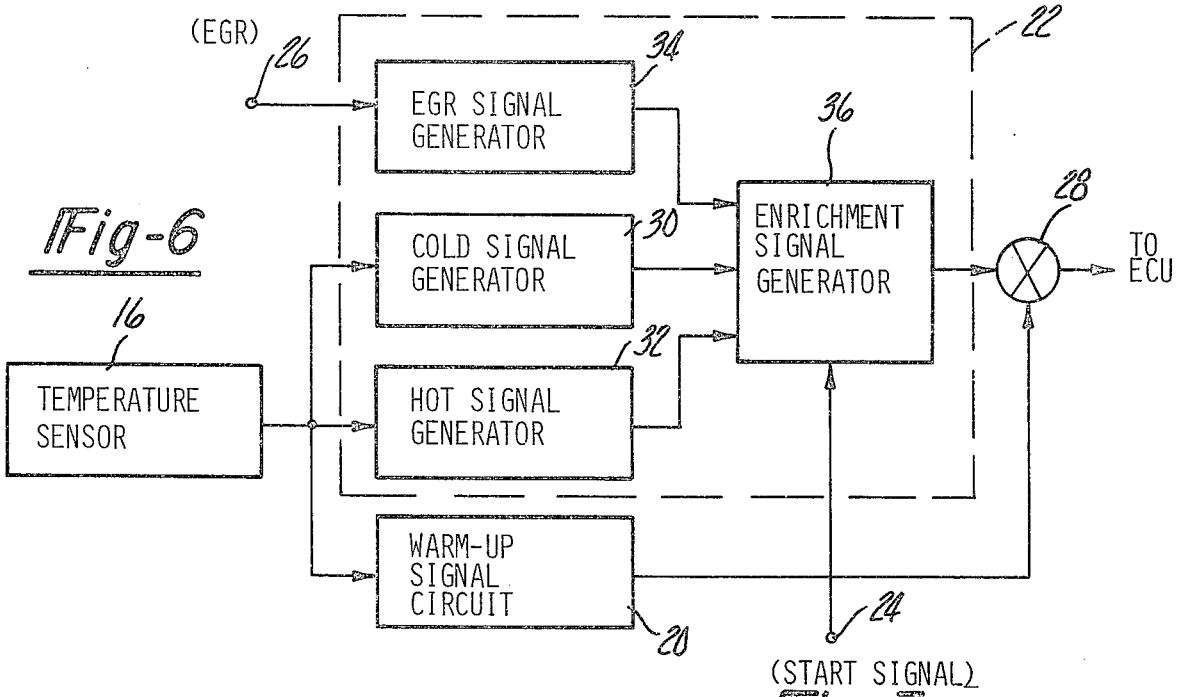
Fig-6
Fig-7
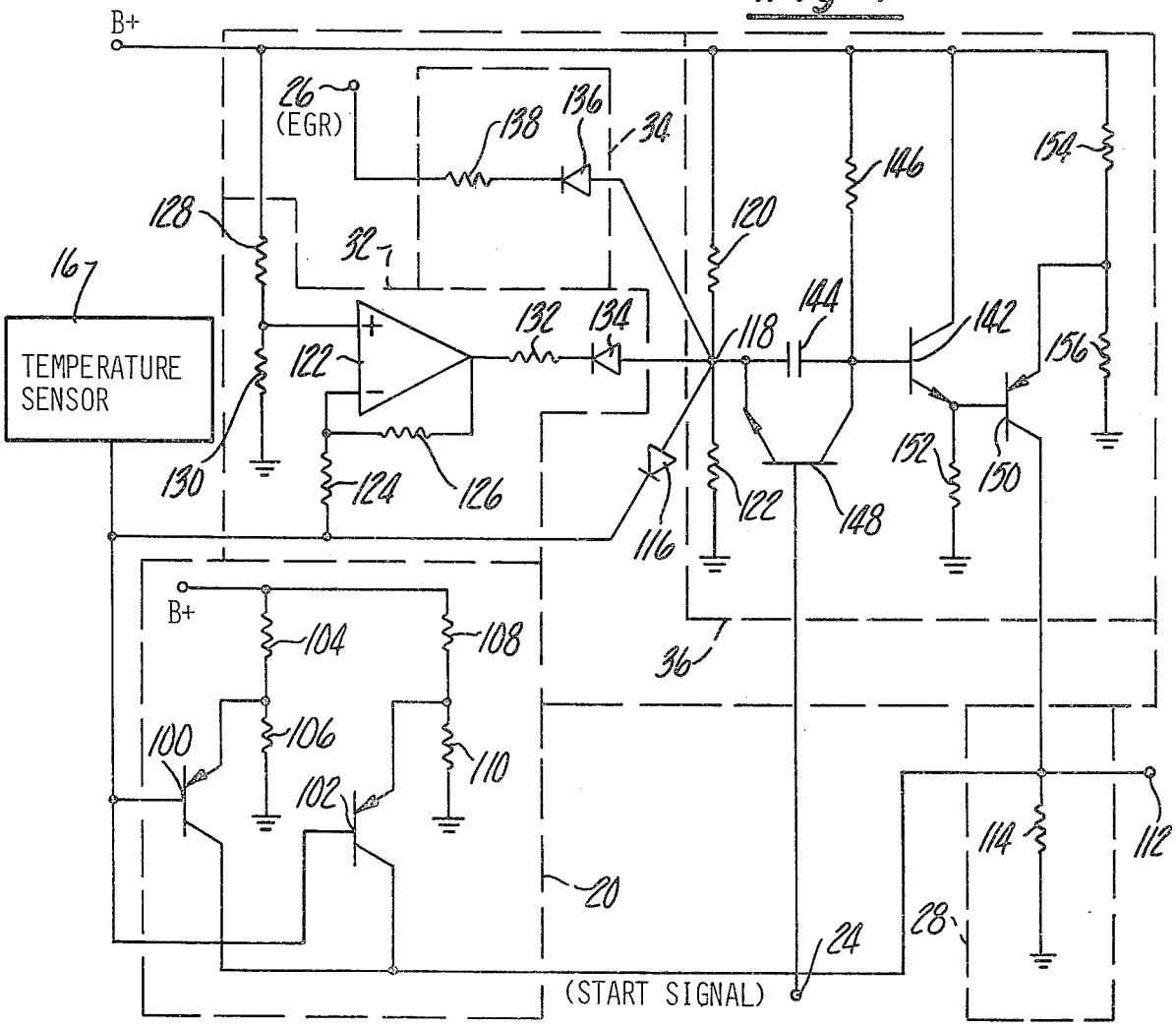

START ENRICHMENT CIRCUIT FOR INTERNAL COMBUSTION ENGINE FUEL CONTROL SYSTEM

BACKGROUND OF THE INVENTION

1. Field of the Invention

The invention is related to electronic fuel injection systems for internal combustion engines and in particular to a circuit for generating a fuel enrichment signal increasing fuel delivery to the engine during a start attempt.

2. Description of the Prior Art

It is well known by those skilled in the art that the air/fuel mixture supplied to an internal combustion engine during a start attempt and for a short period of time immediately following a successful start should be enriched to facilitate starting the engine and to sustain the operation of the engine after it has been started. This enrichment is in addition to the conventional warm-up enrichment. A hot engine as used herein designates an engine whose temperature is higher than the normal operating temperature. The hot engine condition normally referred to as a "hot soak" occurs for a period of time after the engine has been stopped after sustained operation. During the period when the engine is hot, fuel in the fuel injectors and fuel lines supplying fuel to the injectors experiences a similar increase in temperature and decreases the density of the fuel. Therefore, the quantity of fuel being injected into the engine is less than the quantity required to sustain operation. The problem becomes even more aggrevated when the temperature is sufficient to cause partial vaporization of the fuel thereby reducing the delivered quantity of fuel even further. Fortunately, this problem only exists for a short period of time after the engine has been started. As the hot fuel is delivered to the engine, it is replaced with fuel at ambient temperature and the fuel delivery soon returns to normal.

The need for temporarily enriching the air/fuel mixture to the engine during a start attempt and for a short period of time immediately following a cold start is eminently more well known and provisions for enriching the air/fuel mixture following starts are presently part of most fuel control systems, both mechanical as well as electronic.

SUMMARY OF THE INVENTION

The invention is a start enrichment circuit for an electronic fuel control system which provides for temporary fuel enrichment during a hot start or cold start and for a time thereafter determinable from the temperature of the engine. The circuit provides a signal to the electronic control unit of an electronic fuel control system having a temperature dependent initial value which decays as a function of time after a successful start. The initial value of the generated signal is an inverse function of temperature below the normal operating range of the engine and a direct function of the engine temperature above the normal operating range of the engine. Provisions are also made to enrich the fuel mixture during starting and a short time thereafter in the temperature range when the exhaust recirculation valve is opened. This compensates for the admission of air rather than recirculated exhaust gasses into the intake manifold during the start attempt. The start enrichment circuit comprises at least two temperature signal generators. The first signal generator generates a signal having a value which is an inverse function of the engine temperature when the engine's temperature is below the normal operating temperature range of the engine, and the second signal generator generates a signal having a value which is a direct function of the engine temperature when the engine's temperature is above the normal operating temperature range of the engine. When the engine has an exhaust gas recirculating system recirculating a portion of the exhaust gasses back into the intake manifold when the operating temperature of the engine exceeds a predetermined temperature, the start enrichment circuit also includes a third signal generator generating a signal compensating for the additional air being supplied by the exhaust gas recirculation system.

The signals generated by said first, second and third signal generators are input to an enrichment signal generator which is activated by a signal indicative of the engine's starter being energized. The enrichment signal generator generates an enrichment signal having an initial value proportional to the value of the signals generated by said first, second and third signal generators in response to said start signal. After said start signal is terminated the signal generated by the start enrichment generator decays to zero at a predetermined rate. The start enrichment signal is added to the warm-up enrichment signal and enriches the fuel delivery to the engine during the starting attempt.

The object of the invention is a start enrichment circuit which generates a start enrichment signal during the starting of an internal combustion engine and for a time thereafter when the engine temperature is above or below the normal operating temperature range.

Another objective of the invention is to generate a start enrichment signal having an initial value which is an inverse function of engine temperature when the engine is cold and a direct function of the engine temperature when the engine is hot.

Still another objective of the invention is to generate a start enrichment signal having a predetermined initial value when the engine embodies an exhaust gas recirculation system, and said exhaust gas recirculation system is activated.

These and other advantages of the invention will become apparent from a reading of the following specification with reference to the figures.

BRIEF DESCRIPTION OF THE FIGURES

FIG. 6 is a block diagram of the start enrichment circuit in combination with a typical warm up enrichment circuit.

FIG. 7 is a circuit diagram of the start enrichment circuit in combination with a warm up enrichment circuit.

DETAILED DESCRIPTION OF THE PREFERRED EMBODIMENT

Figure 1:
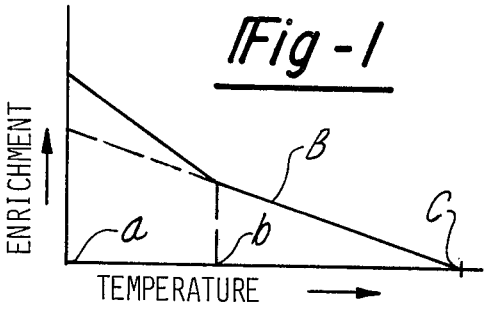
FIG. 1 is a graph illustrating the fuel enrichment requirements of an engine for a cold engine during warm up.

FIG. 1 is a graph illustrating a typical warm up enrichment schedule for an internal combustion engine as a function of engine temperature. In an arbitrary cold temperature region, for example, between −40° C. and 0° C., designated in FIG. 1 as temperatures "*a*" and "*b*", respectively, the enrichment decreases at a first rate as a function of temperature. In the arbitrary temperature range between 0° C., point "*b*" and about 50° C., point "*c*", the enrichment decreases at a second rate as a function of temperature which is less than the first rate. Point "*c*" defines the lower limit of the normal operating temperature range of the engine. The warm up enrichment curve is designated as the "B" curve for the purposes of subsequent discussions herein. It is recognized that the "B" curve may take forms other than the two segment curves illustrated and the temperatures at which warm up enrichment is terminated and the break point "*b*" may also be different than those stated above depending upon the characteristics of the engine.

Figure 2:
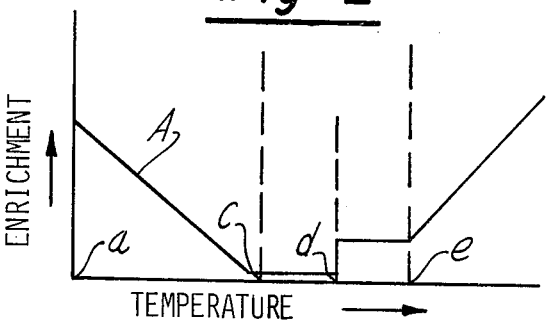
FIG. 2 is a graph illustrating the start enrichment required for starting the engine to which the invention is directed.
Figure 3:
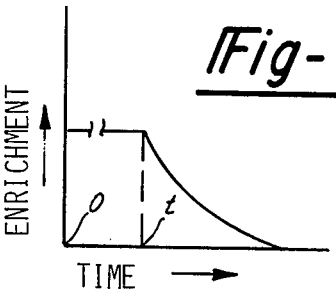
FIG. 3 is a graph illustrating the time profile of the start enrichment curve of FIG. 2.

A start enrichment schedule of the invention is shown in FIG. 2. The arbitrary values shown are the initial values of the start enrichment which decays with time as illustrated in FIG. 3. Referring back to FIG. 2, the initial value of the start enrichment decays as a function of temperature in an arbitrary temperature range from −40° C. to +50° C. designated as points "*a*" and "*c*" as in FIG. 1. At a temperature "*d*" which is hotter than temperature "*c*" the exhaust gas recirculation system becomes operative. To compensate during the start for the increased air flow into the engine's intake manifold, a step function enrichment illustrated in the temperature range from "*d*" to "*e*" is provided. The temperature range from the points designated "*c*" and "*e*" represents the normal operating temperatures of the engine and, for example, may range from 50° C. to 85° C. Above the temperature designated by point "*e*" the start enrichment increases linearly as a function of temperature as illustrated. The start enrichment curve illustrated in FIG. 2 is designated as the "A" curve for all subsequent discussions herein.

Figure 4:
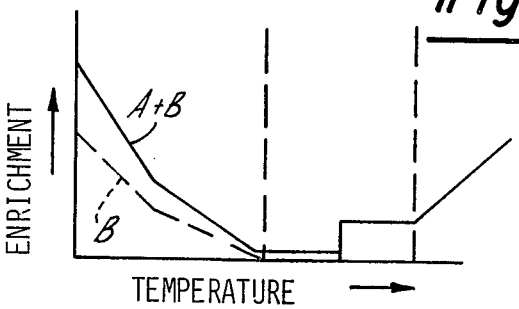
FIG. 4 is a graph showing the composite enrichment illustrated in FIGS. 1 and 2 during the start attempt.

The start enrichment as a function of time is illustrated in FIG. 3. In the time interval designated between time O and "*t*" the starter is energized and the fuel supplied to the engine is enriched at a constant rate, as illustrated. Upon termination of the energization of the starter the start enrichment decays rather rapidly as a function of time. The time that the start enrichment is supplied to the engine after the starter is de-energized is primarily a function of the initial value as is obvious to those skilled in the art. The combined enrichment of the "A" curve and the "B" curve is illustrated in FIG. 4.

Figure 5:
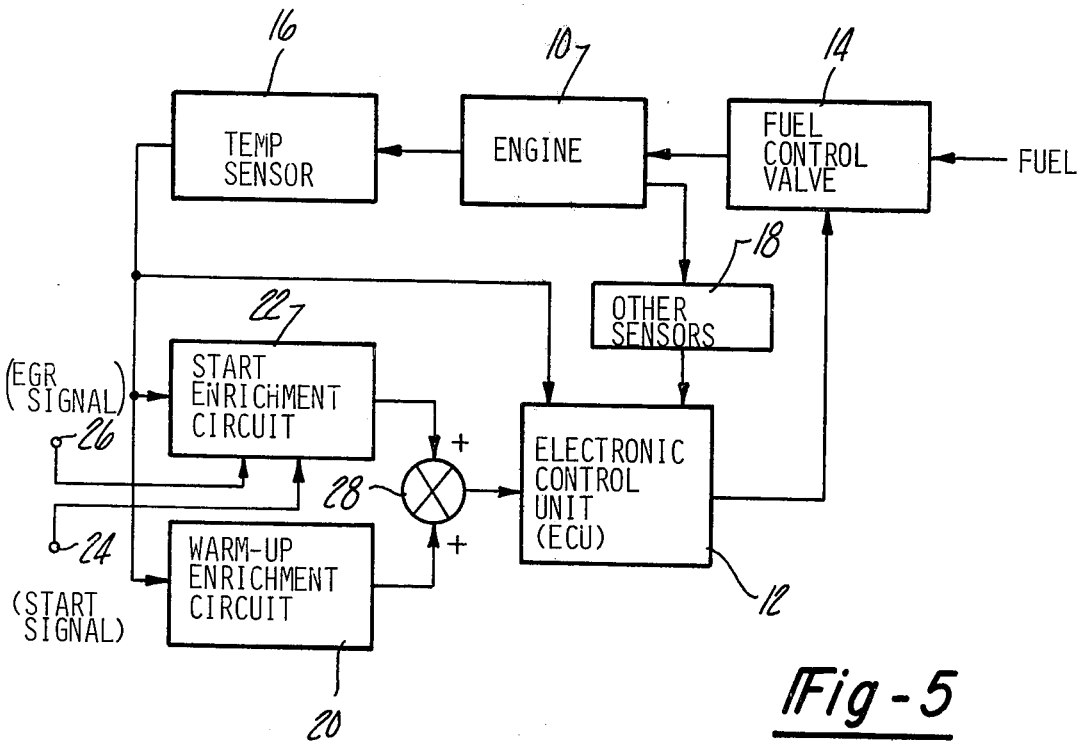
FIG. 5 is a block diagram showing the interrelationship of the start enrichment circuit with an electronic fuel control system.

The relationship of the start enrichment circuit to an electronically fuel injection system is illustrated in FIG. 5. Fuel delivery to an internal combustion engine 10 is controlled by an electronic control unit 12 controlling the operation of a fuel delivery device. The fuel delivery device may be a plurality of fuel injectors in a fuel injection equipped engine or may be an electronically controlled carburetor in a more conventional type engine and controls the fuel delivery to the engine 10 in response to the signal received from the control unit 12. The engine is normally equipped with a plurality of sensors generating signals indicative of the engine's operating parameters. These sensors may include a temperature sensor 16, as well as other sensors, such as a manifold pressure sensor, engine speed sensor, ambient air temperature sensors, torque sensors and others which are collectively designated as other sensors 18. The electronic control unit 12 in response to the signals generated by the sensors including temperature sensor 16 computes the fuel requirements of the engine and controls the fuel supplied to the engine by the fuel delivery device 14.

The electronic fuel control unit may embody a plurality of auxiliary circuits providing signals to the electronic control unit to compensate for special operating conditions, such as warm up, full load, deceleration and others. Normally included in these auxiliary circuits is a warm up enrichment circuit 20, as illustrated. The warm up enrichment circuit 20 receives a signal from the temperature sensors 16 and provides a signal to the electronic control unit 12 to increase the fuel flow to a cold engine as a function of the engine temperature as illustrated in FIG. 1. The disclosed start enrichment circuit 22 also receives a signal from the temperature sensor 16 along with a signal indicative that the starter has been energized appearing at terminal 24 and a signal indicative that the exhaust gas recirculation system (EGR) has been activated appearing at terminal 26. The start enrichment circuit 22 generates a signal indicative of the "A" curve shown in FIG. 2 which is summed with the warm up enrichment signal generated by the warm up enrichment circuit 20 in a sum circuit 28. The output of the sum circuit is a sum of the signal generated by the start enrichment circuit 22 and the warm up enrichment circuit 20, as illustrated in FIG. 4, and is input to the electronic control unit 12. Electronic control unit 12 responds to the sum signal and the output signal generated is modified to provide an increased fuel flow of the engine 10.

The block diagram of FIG. 6 further delineates the subcomponent parts of the start enrichment circuit in combination with the warm up signal circuit 20. The start enrichment circuit comprises a cold signal generator 30 and a hot signal generator 32 both receiving signals from the temperature sensor 16. When the engine embodies an exhaust gas recirculation system, the start enrichment circuit also includes an EGR signal generator 34 receiving a signal at terminal 26 indicative that the EGR system is in operation. The signals generated by the cold signal generator, the hot signal generator and EGR signal generator are applied to an enrichment signal generator 36. The enrichment signal generator 36 is activated in response to a start signal appearing at terminal 24 indicative that the engine starter is energized. As long as a start signal appears on terminal 24 the initial value of the "A" curve as determined by the cold signal generator, hot signal generator, or EGR signal generator is applied to one gate of the sum circuit 28. As discussed relative to FIG. 5, a temperature signal from temperature sensor 16 is also applied to the warm up signal circuit 20 which generates a warm up signal which is applied to an alternate input of sum circuit 28 where the two signals are summed prior to being transmitted to the electronic control unit 12.

The operation of the start enrichment circuit is as follows: When the signal generated by temperature sensor 16 is indicative of a temperature in the range between the temperatures designated "*a*" and "*c*" in FIG. 2, the cold signal generator 30 generates a signal which is an inverse function of the engine's temperature. When the temperature is in the temperature range above the point "*d*", the EGR system is activated and the EGR signal generator 34 generates a signal having a predetermined value. When the signal generated by the temperature sensor 16 exceeds the temperature designated by point "*e*" the hot signal generator 32 generates a signal that is greater than that from the EGR signal generator 34 and increases with temperature. The enrichment signal generator 36 responds to the start signal and the signals from the generators 30, 32 and 34 and generates a signal having an initial value as shown in FIG. 2. When the start signal is terminated the enrichment signal decays from its initial value to zero as a function of time. The signal from the enrichment signal generator and the warm up signal generator circuit 20 are summed prior to being communicated to the electronic control unit 12.

The circuit details of the warm up enrichment signal 20 and the start enrichment circuit 22 are shown in FIG. 7. Electrical power from the electrical supply of the internal combustion engine is received at the terminals designated B+ at various locations on the schematic. The terminals designated B+ and the ground symbols have their conventional usage and are used to designate the positive and negative supply terminals of the source of electrical power respectively. As is known in the art the source of electrical supply may be a battery but may be any other source of electrical power.

The output of the temperature sensor is connected to the bases of transistors 100 and 102 in the warm up signal circuit 20. The emitter of transistor 100 is connected to the junction between serially connected resistances 104 and 106 forming a voltage divider between the B+ terminal and ground. The collector of transistor 100 is connected to the collector of transistor 102 and to the output terminal 112. The output terminal 112 is also connected to ground through a resistance 114. The emitter of transistor 102 is connected to the junction between serially connected resistances 108 and 110 forming a voltage divider between the B+ terminal and ground. The serially connected resistances 104 and 106 and 108 and 110 control the potentials applied to emitters of transistors 101 and 102 respectively, and determine the two different slopes of the warm up enrichment curve "B" illustrated in FIG. 1.

The output of the temperature sensor is also connected to the cathode of a diode 116 having an anode connected to a junction 118 between serially connected resistances 120 and 122 forming a voltage divider network between the B+ terminal and ground. The diode 116 constitues the cold signal generator 30 referred to in FIG. 6.

The output of the temperature sensor is also connected to the negative terminal of an inverting differential amplifier 122 through a resistance 124. The output of the differential amplifier 122 is also connected back to the negative input through a resistance 126. The positive input terminal to inverting differential amplifer 122 is connected to the junction between serially connected resistances 128 and 130 forming a voltage divider network between B+ and ground. The output of the differential amplifier 122 is connected to the junction 118 through a resistance 132 and diode 134. The voltage divider network comprising resistances 128 and 130, the differential amplifier 122, resistances 124, 126, 132 and diode 134 comprises the hot signal generator 32 as illustrated in FIG. 6.

Serially connected diode 136 and resistance 138 are connected between the junction 118 of serially connected resistances 120 and 122 and the EGR terminal 26. The value of the EGR signal is a potential approximately equal to B+ for temperatures below the temperature designated in FIG. 2 and is a ground signal for temperatures above the temperature designated "*d*". Resistance 138 in combination with diode 136 comprises the EGR signal generator 34 illustrated in FIG. 6 and produces a signal at junction 118 having a value lower than the potential at junction 118 when the signal at EGR terminal 26 is a ground signal.

Junction 118 is connected to the base of a transistor 142 through a capacitance 144. The base of transistor 142 is also connected to the B+ terminal through a resistance 146. The collector of a transistor 148 is connected to the base of transistor 142 and one electrode of capacitor 144. The emitter of transistor 148 is connected to junction 118 and the other electrode of capacitor 144. The base of transistor 148 is connected to terminal 24 receiving a signal indicative that the engine starter is energized. The collector of transistor 142 is connected to the B+ terminal and the emitter is connected to the base of transistor 150 and to ground through resistance 152. The emitter of transistor 150 is connected to the junction between serially connected resistances 154 and 156 forming a voltage divider network between B+ and ground. The collector of transistor 150 is connected to terminal 112 and to ground through resistance 114. Voltage divider network consisting of resistances 120, 122, capacitance 144, transistors 148, 142 and 150 and associated circuitry comprises the enrichment signal generator 36.

The operation of the circuit shown in FIG. 7 is as follows: The temperature sensor 16 generates a temperature signal having a value which increases as a function of engine temperature. The temperature sensor may detect the temperature of the engine block, the temperature of the coolant or the temperature of the oil (as is common in the art). Referring first to the warm up signal circuit 20, the signal from the temperature sensor is applied to the bases of transistors 100 and 102 respectively. When the temperature is below the temperature designated "*b*" in FIG. 1, the signal applied to the bases of the transistors 100 and 102 is below the potentials applied to their respective emitters by their respective voltage divider networks and both transistors 101 and 102 conduct providing a current flow to terminal 112 which is a sum of the current flowing through both transistors. At the temperature designated "*b*", the potential of the signal generated by the temperature sensor is approximately equal to the potential applied to the emitter of transistor 100 and transistor 100 ceases to conduct. However, transistor 102 continues to conduct until the temperature designated "*c*" in FIG. 1 is reached. At this temperature, the value of the signal generated by the temperature sensor 16 is approximately equal to the value of the potential applied to the emitter of transistor 102 by means of the voltage divider network consisting of resistances 108 and 110 and transistor 102 ceases to conduct terminating the warm up enrichment signal at temperature "*c*".

Referring now to cold signal generator 30 of the start enrichment circuit 22, the signal generated by the temperature sensor is applied directly to junction 118 through diode 116. When the value of the signal generated by the temperature sensor is less than the value of the potential at junction 118 as determined by resistances 120 and 122, the value of the potential at junction 118 is determined by the value of the signal generated by the temperature sensor. Turning now to the enrichment signal generator 36, a start signal applied to terminal 24 causes transistor 148 to conduct and capacitance 144 is discharged to the potential of the temperature signal generated by the temperature sensor. The lower potential applied to the base of transistor 142 decreases its conductivity which in turn lowers the potential applied to the base of transistor 150. A low potential applied to the base of transistor 150 increases its conductance as an inverse function of the potential applied to its base. When the start signal applied to the base of transistor 148 is terminated, capacitance 144 begins to recharge through resistance 146 increasing the potential at the base of 142 thereby increasing its conductance. The increased conductance of transistor 142 raises the potential applied to the base of transistor 150 until the potential at the base of transistor 150 becomes approximately equal to the potential applied at the emitter of transistor 150 as determined by the voltage divider network comprising resistances 154 and 156. When the potential at the base of transistor 150 is approximately equal to the potential applied to the emitter, transistor 150 ceases to conduct terminating the start enrichment signal.

The signal generated by the temperature sensor is also applied to the negative input of the differential amplifier 122. The potential generated by the voltage divider comprising resistances 128 and 130 is applied to the positive terminal of the differential amplifier 122. The output of differential amplifier 122 is inverted so that when the temperature signal is low its output is high and when the temperature signal is high the output is low. The output of the differential amplifier is applied to junction 118 through resistance 132 and diode 134. The value of the components associated with the differential amplifier 122 are selected so that the ouptut of the differential amplifier 122 becomes lower than the potential generated at junction 118 at a predetermined temperature between temperatures designated "*d*" and "*e*" in FIG. 2. The signal indicative that the EGR system is operative is a ground signal applied to terminal 26. The ground signal is applied to junction 118 through resistance 138 and diode 136. The operation of the enrichment signal generator 36 in response to a low signal applied by means of the hot signal generator 32 and the EGR signal generator 34 is the same as discussed with regards to the cold signal generator 30.

Figure 8:
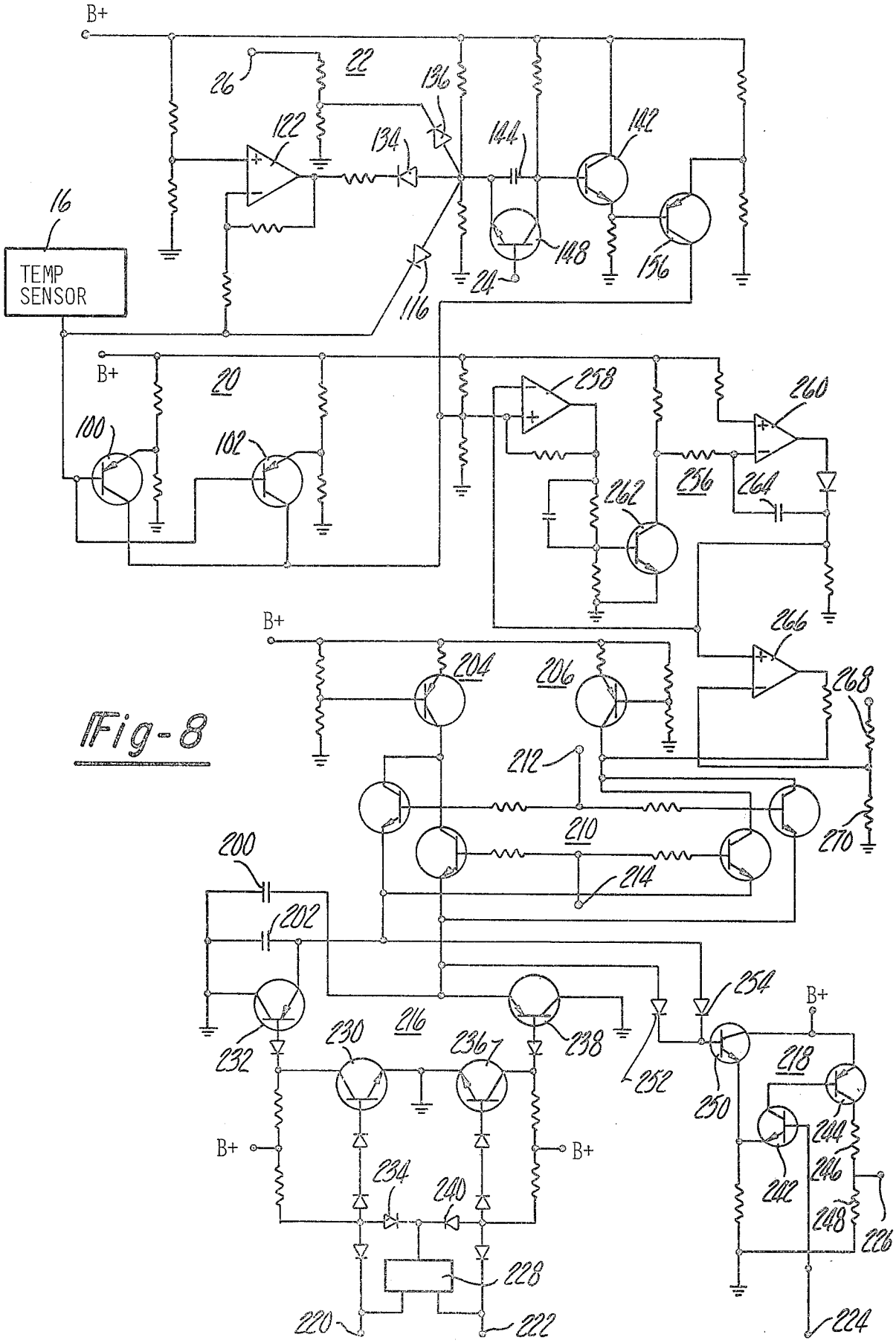
FIG. 8 is a circuit diagram of an electronic control unit for an electronic fuel injection system embodying the start enrichment circuit.

A circuit implementation of the start and warm up enrichment circuits 22 and 20 illustrated in FIG. 7 in combination with an electronic control unit 12 of the type disclosed by Reddy in U.S. Pat. No. 3,734,068 "Fuel Injection Control System", is shown in FIG. 8. The circuit is powered from a source of electrical energy designated at various points on the diagram as B+. The source of electrical power may be a battery or engine driven source, such as an alternator or generator conventionally associated with an internal combustion engine. The electronic control unit 12 has two capacitors 200 and 202 alternately charged by means of a pair of current sources 204 and 206 under the control of a switching network 210. The switching network receives trigger signals at input terminals 212 and 214 from a timing circuit (not shown), synchronized with the rotation of the engine.

The pulse generating circuit comprises a discharge circuit 216 and a comparator circuit 218. The discharge circuit 216 receives timing signals from the timing circuit at input terminals 220 and 222 while the comparator circuit 218 receives a load signal at terminal 224, such as a signal from a pressure sensor generating a signal indicative of the pressure in the engine's air intake manifold. The comparator 218 generates an output pulse signal at terminal 226 indicative of the engine's fuel requirements in response to the potentials on capacitors 200 and 202 and the value of the pressure signal.

Figure 9:
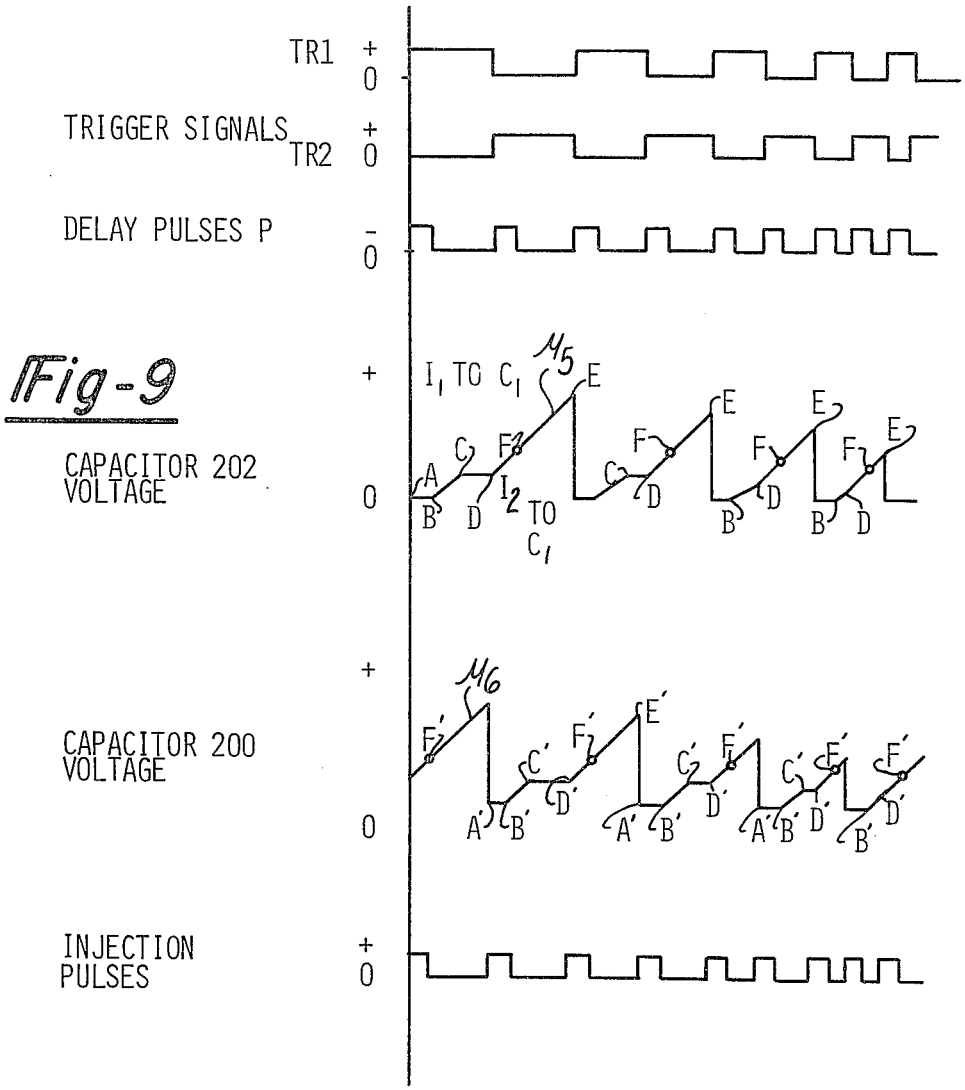
FIG. 9 is a graph showing the signal waveforms at various locations in the electronic control unit.

The operation of the electronic control unit is discussed with reference to FIG. 8 and the waveforms shown in FIG. 9. Current source 204 is a constant current source capable of charging capacitors 200 and 202 at a predetermined rate to a predetermined value. Current source 206 is also a constant current source having a constant current output signal operative to charge capacitors 200 and 202 at a predetermined rate to potentials well above the predetermined value of current source 204. The trigger signals TR1 and TR2 in the form of two alternating square waves, as illustrated in FIG. 9, are respectively applied to input terminals 212 and 214 of switch 210 and control the sequential charging of the capacitors 200 and 202 by the two current sources 204 and 206. In the interval when the signal TR1 is positive and the signal TR2 is negative or a ground potential, capacitor 202 is charged by current source 204 and capacitor 200 is charged by current source 206. When the trigger signals reverse polarity, the two capacitors are charged by the alternate current source.

The leading edges of the trigger pulses TR1 and TR2 applied to the discharge circuit 216 activates a delay pulse generator 228, such as a single shot multivibrator which generates a dealy pulse "*p*" having a predetermined pulse width significantly shorter than pulse width of the trigger pulse. A positive trigger signal on input terminal 220 coincident with the positive delay pulse signal "*p*" removes the effective ground potential on the base of transistor 230 causing it and transistor 232 to conduct. Transistor 232 discharges capacitor 202 to near ground potential during the period of the delay pulse. Termination of the delay pulse returns a ground potential at the output of the delay pulse generator 228 which is applied to the base of transistor 230 through diode 234. The ground signal at its base blocks transistor 230 which in turn blocks transistor 232 permitting capacitor 202 to be charged by current source 204 to the predetermined value. When the trigger signals TR1 and TR2 change polarity, a positive potential is applied to terminal 222 and the delay pulse "*p*" permits the base of transistor 236 to be forward biased and capacitor 200 is discharged by means of transistor 238 in a manner equivalent to the way capacitor 202 was discharged. The switching network 210 also changes state in response to the inversion of the trigger signals and capacitor 202 is charged from current source 206 and capacitor 200 is charged from current source 204.

The pressure signal applied to pressure input terminal 224 forward biases transistor 242 which in turn forward biases transistor 244. The conductance of transistor 244 produces a positive potential at output terminal 226 which is connected to the junction between resistances 246 and 248 forming a voltage divider network between the collector of transistor 244 and ground. The conductance of transistor 242 also biases the emitter of transistor 240 to a potential approximately equal to the value of the pressure signal appearing at terminal 224. The charge signals on capacitor 200 and 202 are applied to the base of transistor 250 through diodes 252 and 254 respectively. When the signals on both capacitors have a potential value below the value of the pressure signal, transistor 240 is blocked. However, when the potential value on either capacitor 200, 202 or both exceed the value of the pressure signal, transistor 250 conducts. Conductance of transistor 250 raises the value of the potential appearing at the emitter of transistor 242 above the value of the pressure signal applied to its base thereby blocking transistor 242. Blocking of transistor 242 blocks transistor 244 and with transistor 244 in the blocked state, the potential at output terminal 226 assumes a ground potential terminating the output signal.

The voltage waveforms generated across capacitors 200 and 202 in response to a series of trigger signals TR1 and TR2 and the delayed pulse "*p*", are shown in FIG. 9. The decreasing period of the sequential trigger signals illustrated is an exaggerated example of the change in the pulse width of the trigger signals as a function of engine speed. Referring to the waveform for capacitor 202, the initial segment from A to B is generated when TR1 is positive and the delay pulse generating circuit is producing a delay pulse "*p*" discharging capacitor 202. Upon termination of the delay pulse "*p*", point B, capacitor 202 begins to charge at a rate determined by current source 204 to its predetermined value indicated as point C. The charge on capacitor 202 remains at the predetermined value for the remainder of the positive portion of the trigger signal TR1. At point D, the trigger signals TR1 and TR2 reverse polarity and capacitor 202 is now charged by the current source 206 during the interval from D to E which is equal to the interval when the trigger pulse TR2 is positive.

When the charge on either capacitor 200 or 202 reaches the value of the signal applied to the emitter of transistor 250 point F, the signal at the output terminal 226 is a ground potential. At the occurrance of a trigger signal, the capacitor which was being charged by current source 206 is discharged to approximately ground potential by the discharge circuit 216 and the charge on the capacitor being charged by current source 204 is below the value of the signal applied to the emitter of the transistor 250, which is indicative of the value of the pressure signal. Since the charge on both capacitors is below the value of the pressure signal, transistor 250 is blocked, which renders transistors 242 and 244 conductive generating a positive signal at output terminal 226 having a value determined by the respective value of resistances 246 and 248. The signal at output terminal 226 remains positive until the charge on the capacitor being charged by current source 206 exceeds the value of the pressure signal. When the charge on the capacitor exceeds the value of the pressure signal, point F on the segment DE, transistors 242 and 244 become blocked and the signal at the output terminal 226 returns to ground potential. The time interval when the signal at output terminal 226 is positive, is indicative of the engine's fuel requirements as a function of engine speed and the pressure in the intake manifold.

Referring back to FIG. 8, the circuit details of the start and warm up enrichment circuits 22 and 20 respectively will be explained. The warm up enrichment circuit 20 receives a signal from the temperature sensor 16 which causes transistors 100 and 102 to conduct, as described with reference to FIG. 7, generating an input current to the input of comparator 258 which is part of a sawtooth wave generator 256. The signals from the temperature sensor 16 are also applied to capacitor 144 through diode 116 and to the negative input of the inverting differential amplifier 122 in the start enrichment circuit 22. The start enrichment circuit also receives a signal at terminal 26 indicative of the exhaust gas recirculation (EGR) system being energized and a signal at terminal 24 indicative of the starter being energized. The start enrichment circuit 22 generates a start enrichment signal at terminal 112 indicative of the "A" curve shown in FIG. 2, as discussed with reference to FIG. 7. The start enrichment signal is summed with the warm up enrichment signal applied to differential amplifier 258 in the sawtooth wave generator 256. The sawtooth wave generator 256 comprising differential amplifier 258, Norton amplifier 260, transistor 262 and associated circuitry, generates a sawtooth wave having a peak value which is proportional to the value of the signal received from the start and warm up enrichment circuits. The details of the sawtooth wave generator 256 are discussed in detail in U.S. Pat. No. 3,971,354 "Increasing Warm Up Enrichment as a Function of Manifold Absolute Pressure" issued to Luchaco et al in July 1976. Briefly, differential amplifier 258 has an uncommitted npn collector and signal applied to differential amplifier 258 and is also applied to the base of transistor 262 causing it to conduct. Conduction of transistor 262 reduces the potential at the negative input of amplifier 260 terminating the current flow and the output of the Norton amplifier becomes positive charging capacitance 264 and increasing the potential applied to the negative input of the differential amplifier 258. When the potential at the negative terminal of differential amplifier 258 is less than the potential applied to the positive terminal, a ground signal appears at the npn uncommitted collector output terminating the conductance of transistor 256, applying a positive potential to the negative input of Norton amplifier 260 and recharging capacitance 264. When capacitance 264 is recharged, the output of the Norton amplifier is a ground signal which when applied to the negative input of differential amplifier 258 causes the collector to become uncommitted again.

The signal generated across capacitance 264 is applied to differential amplifier 266 which also has an uncommitted npn collector. The potential applied to the negative input of differential amplifier 266 is derived from a voltage divider comprising resistances 268 and 270 connected between B+ and ground. When the signal applied to the positive terminal is more positive than that applied to the negative terminal, the collector of uncommitted npn differential amplifier becomes a ground signal forming a current sink for a portion of the current I generated by current source 206. When current is being drained from the current generator, the rate at which capacitances 200 or 202 is charged is decreased thereby extending the duration of the injection pulses generated by the electronic control unit 12 as shown in FIG. 10.

Figure 10:
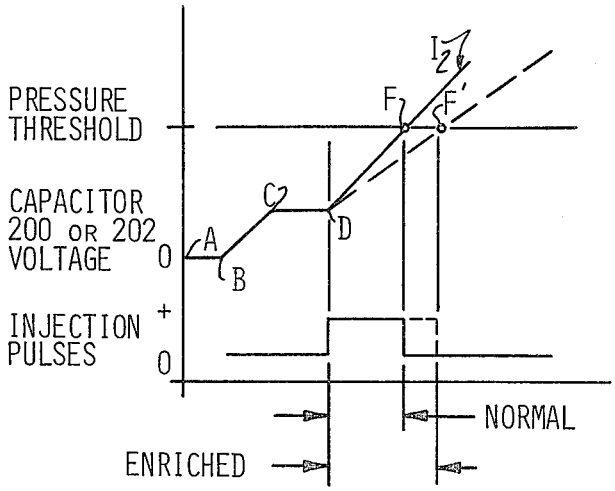
FIG. 10 is a graph showing the effect of the start enrichment signal on the output waveform of the electronic control unit.

Referring to FIG. 10, the rate of charge on capacitance 200 or 202 by the current source 206 with no enrichment is shown as a solid line, while the rate of charging capacitance 200 or 202 when current is drained from current source 206 in response to the signals generated by the start and warm up enrichment is shown by the dashed line. The decrease in the charge rate, extends the pulse width of the injection signal as discussed relative to FIG. 8.

Although a fuel control system embodying the start and warm up enrichment circuit has been described with reference to a specific type of electronic control unit and is described with specific circuitry, it is not intended that the invention be limited to the circuits illustrated and described. One skilled in the art will readily recognize that the concept disclosed may be applied to other types of electronic control units and that the functions provided by this specific circuit illustrated and described herein need be performed by other circuits without departing from the spirit of the invention.

What is claimed is:

1. In combination with an electronic fuel control system for an internal combustion engine wherein said internal combustion engine has an electrically energized starter including a starter switch generating a start signal operative to energize the starter and the electronic fuel control system includes sensors generating signals indicative of the engine's operating parameters including a temperature sensor generating a signal indicative of the engine's temperature, a fuel control computer generating output signals indicative of the engine's fuel requirements in response to input signals including the signals generated by the sensors, and a fuel delivery means controlling the amount of fuel delivered to the engine in response to the output signals generated by the fuel control computer, a start enrichment circuit comprising:

means for generating a start enrichment signal in response to the temperature signal and the start signal, said enrichment signal having a first initial value which is an inverse function of the engine temperature below a first predetermined temperature and a second initial value which is a direct function of engine temperature above a second predetermined temperature, a third initial value between said first predetermined temperature and a third predetermined temperature, said third predetermined temperature intermediate said first and second predetermined temperatures, and a fourth initial value different from said third initial value between said second and third predetermined temperatures, said start enrichment signal maintaining its first, second, third, and fourth initial values during the presence of said start signal and decaying to zero after the termination of said start signal in a time determined by said initial values wherein said fuel control computer generates signals indicative of an increased fuel delivery to the engine in response to said start enrichment signal.

2. The combination of claim 1 wherein said engine further includes an exhaust gas recirculation system having means responsive to the temperature signals for generating an EGR signal activating said exhaust gas recirculating system when the engine's temperature is above said third predetermined temperature, said means for generating a start enrichment signal comprises:

first means for generating a first signal indicative of said first initial value in response to said temperature signal;

second means for generating a second signal indicative of said second initial value in response to said temperature signal; and third means for generating a third signal indicative of said third initial value;

fourth means for generating a fourth signal indicative of said fourth initial value in response to said EGR signal, said fourth signal having a value less than said third signal; and fifth means for generating said start enrichment signal in response to said first, second, third and fourth signals and said start signal.

3. The combination of claim 2 wherein said sensor means generates a temperature signal having a value increasing linearly as a function of engine temperature and having said third predetermined value at said first predetermined temperature, said first means is a diode disposed between said temperature sensor and said third means limiting the current flow in a direction from said third means to the temperature sensor;

said second means comprises:

differential amplifier means for generating said second signal, said differential amplifier means generating said second signal having a value decreasing as an inverse function of the temperature signal and having a value equal to said fourth signal at said second predetermined temperature; and a diode connected between the output of said differential amplifier means and said third means for limiting the current flow to a direction from said third means to said differential amplifier means;

said fourth means comprises:

a first voltage divider network for generating a potential having a value equal to said signal in response to said EGR signal; and a diode connected between said third means and said first voltage divider network for limiting current flow to a direction from said third means to said first voltage divider network;

said third means is a second voltage divider network generating a potential having a value equal to said third signal at an input terminal, said input terminal further receiving said first, second and fourth signals and assuming the value of said first second and fourth when any of said signals have a value lower than said third signal; and said fifth means comprises:

time varient signal generating means connected to the input terminal of said second voltage divider network for generating a first control signal indicative of the value of the signal applied to the input terminal having the lowest value in response to said start signal, and a second control signal after the termination of said start signal, said second control signal changing from the value of said first control signal to a predetermined value as a function of time dependant upon the value of said first control signal; and amplifier means for generating said start enrichment signal in response to said first and second control signal.

4. The system of claim 3 wherein said internal combustion engine includes a source of electrical power having a positive terminal and a negative terminal;

said second voltage divider network comprises a first and second resistance connected serially between said positive and negative terminals and said input terminal is the junction between said first and second resistance; and said time varient signal generator means comprises:

a transistor having a collector connected to said positive terminal, an emitter connected to the input of said amplifier means and a base;

a third resistance connected between said emitter and said negative terminal;

a capacitance having one electrode connected to the junction between said first and second resistance and a second electrode connected to the base of said transistor;

a fourth resistance connected between the base of said transistor and said positive terminal; and gate means having one terminal connected to said one electrode and a second terminal connected to said other electrode and a gate electrode receiving said start signal, said gate means having a low impedance in response to a start signal and a high impedance in the absence of a start signal, said gate means operative to discharge said capacitance in response to said start signal to the value of the lowest signal at the input terminal of said voltage divider network.

5. An enrichment circuit for an internal combustion engine electronic fuel control system for providing fuel enrichment during start and warm up periods wherein said internal combustion engine has an electronically energized starter including a start switch generating a start signal operative to energize the starter and the electronic fuel control system includes sensors generating signals indicative of the engine's operating parameters including a temperature sensor generating a signal indicative of the engine's temperature, a fuel control computer generating output signals indicative of the engine's fuel requirements in response to input signals including the signals generated by the sensors, and a fuel delivery means controlling the amount of fuel delivered to the engine in response to the output signals generated by the fuel control computer comprising:

means for generating warm up enrichment signals in response to the temperature signal, said warm up enrichment signal having a value which is an inverse function of engine temperature for temperatures below a first predetermined temperature and a value equal to zero for engine temperatures above said first predetermined temperature; and means for generating a start enrichment signal in response to the temperature signal and the start signal, said enrichment signal having a first initial value which is an inverse function of engine temperature for temperatures below said first predetermined temperature and a second initial value which is a direct function of engine temperature above a second predetermined temperature, a first predetermined value between said first predetermined temperature and a third predetermined temperature intermediate said first and said second predetermined temperatures, and a second predetermined value different from said first predetermined value between said second and third predetermined temperatures, said start enrichment signal maintaining its first and second initial values and said first and second predetermined values during the presence of said start signal and decaying to zero after the termination of said start signal in a time determined by said first and second initial and predetermined values; and circuit means for summing said warm up enrichment signal with said start enrichment signal;

wherein said fuel control computer generates signals indicative of an increased engine fuel requirement in response to said sum signal.

6. The enrichment circuit of claim 5 wherein said engine further includes and exhaust gas recirculation system having means responsive to the signals generated by the temperature sensor for generating an EGR signal activating said exhaust gas recirculation system when the engine's temperature is above said third predetermined temperature, said means for generating a warm up enrichment signal comprises:

amplifier means for generating an output signal having a value which is an inverse function of engine temperature in response to said temperature signal; and bias means for generating a bias signal operative to terminate the output signal generated by said amplifier means when the temperature signal is indicative of an engine temperature equal to said first predetermined temperature; and said means for generating a start enrichment signal comprises:

first means for generating a first signal indicative of said first initial value in response to said temperature signal;

second means for generating a second signal indicative of said second initial value in response to said temperature signal;

third means for generating a third signal indicative of said first predetermined value;

fourth means for generating a fourth signal indicative of said second predetermined value in response to the EGR signal wherein said fourth signal has a value less than said third signal; and generator means for generating said start enrichment signal in response to said first, second, third and fourth signals and said start signal.

7. The enrichment circuit of claim 6 wherein said amplifier means comprises:

first amplifier means for generating an output signal having a value which is a first inverse function of engine temperature in response to said temperature signals; and second amplifier means for generating a signal having a value which is a second inverse function of engine temperature in response to said temperature signal;

and wherein said biasing means comprises:

a first biasing means generating a signal operative to terminate the signal generated by said first amplifier means when said temperature signal is indicative of a fourth predetermined temperature, said fourth predetermined temperature indicative of a temperature lower than said first predetermined temperature; and second biasing means for generating a second bias signal operative to terminate the output of said second amplifier means when the temperature signal is indicative of an engine temperature equal to said first predetermined temperature.

8. The enrichment circuit of claim 6 wherein said sensor means generates a temperature signal having a value increasing as a function of engine temperature and having a value equal to said third signal at said first predetermined temperature;

said first means is a diode disposed between said temperature sensor and third means limiting the current flow in a direction from said third means to said temperature sensor;

said second means comprises:

differential amplifier means for generating said second signal, said differential amplifier means generating a signal having a value decreasing as an inverse function of temperature and having a value equal to said fourth signal at said second predetermined temperature; and a diode connected between the output of said differential amplifier means and said third means for limiting the current flow to a direction from said third means to said differential amplifier means; and said fourth means comprises:

a first voltage divider network generating said fourth signal in response to said EGR signal; and a diode interconnecting said third means and said first voltage divider network for limiting current flow to a direction from said third means to said first voltage divider network;

said third means comprises:

a second voltage divider network generating said third signal at an input terminal, said input terminal further receiving said first second and fourth signals and assuming the value of said first, second and fourth signals when any of said signals have a value lower than said third signal; and said generator means comprises:

time varient signal generating means connected to the input terminal of said voltage divider network for generating a first control signal indicative of the value of the signal applied to the input terminal having the lowest value in response to said start signal, and a second control signal after the termination of said start signal, said second control signal changing from the value of said first control signal to a predetermined value as a function of time dependant upon the value of said first control signal; and amplifier means for generating said start enrichment signal in response to said first and second control signal.

9. The enrichment circuit of claim 8 wherein said internal combustion engine includes a source of electrical power having a positive terminal and a negative terminal:

said second voltage divider network comprises a first and a second resistance connected serially between said positive and negative terminals and said input terminal is the junction between said first and said second resistance; and said time varient signal generator means comprises:

a transistor having a collector connected to said positive terminal, an emitter connected to the input of said amplifier means, and a base;

a capacitance having one electrode connected to the junction between said first and said second resistances, and a second electrode connected to the base of said transistor;

a third resistance connected between the base of said transistor and said positive terminal; and gate means having one terminal connected to said one electrode and a second terminal connected to said second electrode and a gate electrode receiving said start signal, said gate means having a low impedance in response to a start signal and a high impedance in the absence of a start signal, said gate means operative to discharge said capacitance in response to said start signal to the value of the lowest signal at the input terminal of said second voltage divider network.

10. An electronic fuel control system for an internal combustion engine, wherein said engine includes an electrically energized starter and a switch generating a start signal operative to energize said starter comprising:

sensor means generating signals indicative of the engine's operating parameters, said sensor means including a temperature sensor generating temperature signals indicative of the engine's temperature;

enrichment circuit means for generating an enrichment signal indicative of an increased engine fuel requirement during starting and engine warm up in response to the start signal and said temperature signals, said enrichment signal having a first variable initial value which is an inverse function of the engine temperature in response to the start signal and a temperature signal indicative of an engine temperature below a first predetermined engine temperature, said enrichment signal decaying after the termination of said start signal from said first variable initial value to a temperature dependant value, lower than said first variable initial value, in a time determinable from the difference between said first variable initial value and said temperature dependant value, said enrichment signal having a first predetermined initial value in response to the start signal and a temperature signal between said first predetermined temperature and a second predetermined temperature indicative of an engine temperature intermediate said first predetermined temperature and a third predetermined temperature, said enrichment signal decaying from said first predetermined initial value to zero in a time determinable from the value of said first predetermined initial value to zero in a time determinable from the value of said first predetermined initial value, said enrichment signal further having a second predetermined initial value in response to a start signal and a temperature signal between said second and third predetermined temperatures, said enrichment signal decaying after the termination of said start signal from said second predetermined initial value to zero in a time determinable from the value of said second predetermined initial value, and said enrichment signal having a second variable initial value which is a direct function of engine temperature in response to said start signal and said temperature signal indicative of an engine temperature above said third predetermined temperature, said enrichment signal decaying from said second initial value to zero in a time determined by said second variable initial value;

electronic control unit means for generating output signals indicative of the engine's fuel requirements in response to input signals including the signals generated by said sensor means and said enrichment signals; and fuel delivery means for controlling the fuel delivery to the engine in response to the output signals generated by said electronic control unit means.

11. The fuel control system of claim 10 wherein said engine further includes an exhaust gas recirculation system having means responsive to said temperature signal for generating an EGR signal activating said exhaust gas recirculation system when the engine temperature is above said second temperature, said enrichment circuit means comprises:

warm up enrichment means for generating a warm up signal having a value which is an inverse function of engine temperature in response to a temperature signal indicative of an engine temperature below said first predetermined temperature wherein the value of said warm up signal is said temperature dependant value;

cold start signal generator means for generating a cold start signal having a value which is a direct function of engine temperature in response to a temperature signal indicative of an engine temperature below said first predetermined temperature;

hot start signal generator means for generating a hot start signal having a value which is an inverse function of engine temperature in response to a temperature signal indicative of an engine temperature above said second predetermined temperature;

EGR start signal generator means for generating an EGR start signal in response to the EGR signal;

start enrichment signal generator means for generating a start enrichment signal in response to said start signal and the values of said cold start, EGR start and said hot start signals, said start enrichment generator means generating an output signal having an initial value inversely proportional to the values of said cold start, EGR start and hot start signals when said cold start, EGR start and hot start signals are below a second predetermined value and having said first predetermined initial value when said cold start, EGR start, and said hot start signals have values above said second predetermined value, said start enrichment signal decaying from said initial values in a time determined by said initial value; and sum circuit means for summing said warm up signal with said start enrichment signal to generate said enrichment signal wherein the sum of said warm up signal and the initial value of said start enrichment signal generated in response to said cold start signal is said enrichment signal having said first variable value, said enrichment signal generated in response to a temperature signal indicative of a temperature intermediate said first predetermined temperature and said second predetermined temperature is said enrichment signal having said first predetermined initial value, said enrichment signal generated in response to said EGR start signal between said second and third predetermined temperatures is said enrichment signal having said second predetermined value, and said enrichment signal generated in response to said hot start signal is said enrichment signal having said second variable initial value.

12. The fuel control system of claim 11 wherein said temperature sensor means generates a temperature signal having a value increasing as a function of the engine's temperature and having a third predetermined value at said first predetermined temperature;

said warm up enrichment means comprises:

first amplifier means for generating an output signal having a value inversely proportional to said temperature signal; and biasing means for biasing said first amplifier means to generate an output signal having a zero value for all temperature signals having values greater than said third predetermined value;

said cold start signal generator means comprises a first diode having its cathode connected to the output of said temperature sensor and an anode connected to said start enrichment signal generator means, wherein said temperature signal below said third predetermined value is said cold start signal;

said EGR start signal generator means comprises:

a first voltage divider network for generating said EGR start signal in response to said EGR signal; and a second diode having a cathode connected to said first voltage divider network and an anode connected to said start enrichment signal generator means, wherein the EGR signal divided by said first voltage divider network is said EGR start signal;

said hot start signal generator comprises:

differential amplifier means for generating a signal inversely proportional to said temperature signal; and a third diode having a cathode connected to the output of said differential amplifier and an anode connected to said start enrichment signal generator means, wherein the signal generated by said differential amplifier above said third predetermined temperature is said hot start signal; and said start enrichment signal generator means comprises:

a second voltage divider network having an input terminal receiving the signals generated by said temperature sensor and differential amplifier through said first, second and third diodes, said voltage divider network generating a potential at said input terminal equal to said second predetermined value when no EGR signal is being generated and the value of said temperature signal and the value of the signal generated by said differential amplifier means are greater than said third predetermined value, and said input terminal assuming the value of temperature signal the EGR start signal and the signal generated by said differential amplifier when their value is less than said second predetermined value;

time varient signal generating means for generating a first control signal indicative of the value of said signal at such input terminal having the lowest value in response to the start signal, and a second control signal after the termination of said start signal, said second control signal increasing from the value of said first control signal to a fourth predetermined value as a function of time dependant upon the value of said first control signal; and inverter amplifier means for generating said start enrichment signal in response to said first and second control signals, said inverter amplifier being nonconductive in response to a second control signal having said fourth predetermined value.

13. The electronic fuel control system of claim 12 wherein said first amplifier means comprises:

a first transistor having a base receiving said temperature signal, a collector connected to said sum circuit means and an emitter; and a second transistor having a base receiving said temperature signal, a collector connected to said sum circuit means and an emitter, and said biasing means comprises:

a first voltage divider network providing a first intermediate potential to the emitter of said first transistor, said first intermediate potential having a value equal to said third predetermined value; and a second voltage divider network providing a second intermediate potential to the emitter of said second transistor, said second intermediate potential having a value lower than said third predetermined value.

14. The electronic fuel control system of claim 12 wherein said internal combustion engine includes a source of electrical power having a positive terminal and a negative terminal;

said second voltage divider network comprises a first and a second resistance serially connected between said positive and negative terminals and said input terminal is the junction between said first and said second resistance; and said time varient signal generator means comprises:

a transistor having a collector connected to said positive terminal, an emitter connected to the input of said inverter amplifier means and a base;

a third resistance connected between said emitter and said negative terminal;

a capacitance connected between the input terminal and the base of said transistor;

a fourth resistance connected between said base and said positive terminal; and gate means having an input electrode connected to the base of said transistor and an output electrode connected to said input terminal and gate electrode receiving the start signal, said gate means having a low impedance between said input and output electrodes in response to a start signal at said gate electrode, and a high impedance between said input and output electrodes in the absence of the start signal, said gate means operative in response to said start signal to discharge said capacitance to the value of the lowest signal at said input terminal.

* * * * *